US010542347B2

(12) United States Patent
Petracek

(10) Patent No.: US 10,542,347 B2
(45) Date of Patent: Jan. 21, 2020

(54) SPEAKER CABINET TO EFFECTIVELY AMPLIFY THE FULL AND NATURAL SOUND OF AN ACOUSTIC GUITAR

(71) Applicant: Don Petracek, Vacaville, CA (US)

(72) Inventor: Don Petracek, Vacaville, CA (US)

( * ) Notice: Subject to any disclaimer, the term of this patent is extended or adjusted under 35 U.S.C. 154(b) by 0 days.

(21) Appl. No.: 15/613,200

(22) Filed: Jun. 3, 2017

(65) Prior Publication Data

US 2019/0261087 A1 Aug. 22, 2019

(51) Int. Cl.

| | |
|---|---|
| ***H04R 5/02*** | (2006.01) |
| ***H04R 1/40*** | (2006.01) |
| ***H04R 1/02*** | (2006.01) |
| ***H04R 1/28*** | (2006.01) |
| *G10H 3/18* | (2006.01) |

(52) U.S. Cl.

CPC ..... *H04R 5/02* (2013.01); *H04R 1/02* (2013.01); *H04R 1/2811* (2013.01); *H04R 1/403* (2013.01); *G10H 3/18* (2013.01); *H04R 2499/10* (2013.01)

(58) Field of Classification Search

CPC . G10H 3/18; H04R 1/02; H04R 1/403; H04R 1/2811; H04R 5/02; H04R 2499/10

See application file for complete search history.

(56) References Cited

U.S. PATENT DOCUMENTS 5,825,900 A * 10/1998 Jeon ..... H04R 5/02 381/339
6,219,426 B1 * 4/2001 Daniels ..... H04R 5/02 381/17
6,324,292 B1 * 11/2001 Mitsuhashi ..... H04R 1/288 181/151
6,389,146 B1 * 5/2002 Croft, III ..... H04R 1/2842 381/345
6,504,939 B1 * 1/2003 Fukuda ..... H04R 1/021 381/345
8,135,156 B2 * 3/2012 Hu ..... H04R 1/2834 381/345
8,406,444 B2 * 3/2013 Wang ..... H04R 1/345 381/333
8,565,463 B2 * 10/2013 Saiki ..... H04R 1/2811 381/337
2001/0031061 A1 * 10/2001 Coombs ..... H04R 1/2826 381/349
2002/0036113 A1 * 3/2002 Chu ..... H04R 1/2888 181/199

(Continued)

*Primary Examiner* — Brian Ensey

(57) ABSTRACT

A speaker cabinet to effectively amplify an acoustic guitar, comprising of: two chambers, two speaker drivers, a port, and a tube within the port. One speaker driver is mounted onto front of tube to radiate sound outwards, while the rear sound waves radiate through same tube into ported resonant chamber. The second chamber is sealed, is next to ported chamber, and utilizes a second speaker driver. The front sound waves of second driver radiant into ported resonant chamber, while the rear waves radiate into the sealed chamber. The two distinct sound waves now inside ported chamber mix with each other, then flow around the tube and through the port. All three sound waves mix in front of the cabinet. Other embodiments include: Sound deflectors, horn-loading the port, a passive radiator on the sealed chamber to radiate a fourth sound wave, and a guitar shape inside the ported resonant chamber.

20 Claims, 6 Drawing Sheets

(56) References Cited

U.S. PATENT DOCUMENTS

| | | | | |
|---|---|---|---|---|
| 2002/0051552 | A1* | 5/2002 | Schott | H04R 1/2842<br>381/345 |
| 2002/0085731 | A1* | 7/2002 | Aylward | H04R 1/2857<br>381/349 |
| 2005/0087392 | A1* | 4/2005 | Flanders | H04R 1/26<br>181/156 |
| 2005/0178611 | A1* | 8/2005 | Noselli | H04R 1/20<br>181/145 |
| 2006/0045301 | A1* | 3/2006 | Jakubaitis | H04R 1/2811<br>381/345 |
| 2007/0291965 | A1* | 12/2007 | Noro | H04R 1/2834<br>381/182 |
| 2008/0199032 | A1* | 8/2008 | Woelfel | H04R 1/2857<br>381/349 |
| 2009/0003639 | A1* | 1/2009 | Aylward | H04R 1/2857<br>381/349 |
| 2009/0173567 | A1* | 7/2009 | Stiles | H04R 1/2826<br>181/148 |
| 2010/0111343 | A1* | 5/2010 | Hsu | H04R 1/2834<br>381/335 |
| 2013/0105244 | A1* | 5/2013 | Moreton Cesteros | H04R 1/2873<br>181/199 |
| 2015/0156572 | A1* | 6/2015 | Li | H04R 1/28<br>381/386 |

* cited by examiner

SPEAKER CABINET TO EFFECTIVELY AMPLIFY THE FULL AND NATURAL SOUND OF AN ACOUSTIC GUITAR

CROSS REFERENCES TO RELATED APPLICATIONS

The present application claims the benefit of U.S. Provisional Application Ser. No. 62/345,788, filed Jun. 5, 2016 (Jun. 5, 2016)

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention

This invention is related to the field of acoustics and sound reproduction, and further to the sub-class of speaker enclosures with sound modifying means designed to effectively amplify the acoustic guitar, or any other stringed instrument with a resonating chamber.

Background Discussion

Acoustic instruments are made to play using only their own natural sound. As the strings are played, they transmit vibrations to the bridge, saddle, and sound board. Those vibrations are then converted into the sound waves we hear. For many acoustic guitar players, finding a guitar with 'that sound' is a wonderful, satisfying quest—but the journey doesn't end there. Many musicians take the next logical step to amplify the acoustic guitar. A common way to accomplish this is to "mic" it through a public address (PA) system. Another method is to use an electric guitar amp—but a big problem arises in both situations: the loss of the highly desirable natural sound coming from the acoustic guitar. Neither an amp nor a PA can accurately reproduce the full and natural sound of the guitar. The 'voice' of the acoustic guitar, with its sweet sounding complexities, simply gets lost. Instead, it sounds too direct; multiple sound waves packed into a single wave of sound. 'Quacky' is a term sometimes used to describe how negative this is. One benefit is that the guitar is now loud. However, for a discriminating acoustic guitar player and any thoughtful listener, they soon realize there's a big difference between the warm familiar acoustic guitar sound and this other, very one dimensional sound. Thus, there remains a need to provide a means to amplify acoustic stringed instruments to accurately reproduce the full and natural sound of the instrument.

Sound equipment manufacturers are trying to meet this continuing need by developing new amplifiers, pick-ups, microphones, and effects—all geared to get 'that acoustic sound' back. Musicians and distributors are joining in the effort and contributing expertise to get the right combination of sound equipment and dialing in the special effects—still the same problems persist and the felt need remains unaddressed. Musicians desperate for answers, are spending thousands of dollars with little improvement. The following paraphrased excerpts from musician's blogs, forums, and interviews highlight the tension:

> I'm on a quest for quality, amplified acoustic guitar sound . . . never got a good acoustic tone through an amp . . . I didn't like the sound of the PA either . . . why doesn't my amplified guitar sound like my unplugged guitar? . . . it sounds plastic-like and quacky . . . I've spent thousands and the improvement was only marginal . . . as soon as I turn it up, the sound goes south.

Musicians know there's something wrong; they're trying to dial in their sound, but can't. They're trying to match the volume of the band with them but can't without ruining the sound. Sound engineers know the mix they favor but can't achieve, because of an ongoing fight between quality sound with a microphone and the feedback it produces with on-stage monitors. There is good reason for all this frustration: today's acoustic amps cannot reproduce a large part of the natural sound of an acoustic guitar. They are missing as much as a full 50 to 75% of the innate complexities. Fortunately, it is present in the signal from the guitar and instrument cable, it simply needs to be accurately, naturally, and fully reproduced.

BRIEF SUMMARY OF THE INVENTION

The present invention takes an electrical signal source from a musical instrument cable and directs it to two different areas of a speaker cabinet. Each of two speaker drivers then produces sound with unique sound modifying means. The resulting multiple sound waves are brought together and mixed in the front of the cabinet. This sequence of sound is similar to that produced by most stringed instruments, and the inventive cabinet enables it to be amplified cleanly, naturally, and powerfully.

The first sound source in the cabinet comes from a sound hole 'like' area on the front of the cabinet, where a speaker driver is mounted. This speaker driver is mounted inside an opening or port. As well as radiating its sound outward to the listener, it also radiates sound from the back of the cone, down into the cabinet chamber. This is accomplished by means of a tube-like structure on which the speaker driver is mounted. After mixing in the cabinet, the sound returns out and around the same tube and driver. Another function of the tube is to keep the sound waves from the back of the cone from canceling out the sound waves from the front, in the manner of an infinite baffle.

The second major sound source comes from a second driver mounted such that it radiates into the body of the cabinet. The back of this speaker driver is in a sealed enclosure so that it will not overpower the front sound mix. Since the second driver directly radiates into the cabinet, there can be features added inside the cabinet that break up the sound. These include reflectors of various shapes and sizes, made of wood and other materials to help improve the quality of sound by reduce standing waves, especially at higher volumes. These reflectors can also resemble familiar shapes such as an acoustic guitar or violin outline, which already have known desirable sound effects.

The sound waves that are now inside the chamber consist of two distinct sound sources, and they flow out and around the first driver (radiating outwards) and mix with a third sound source. There is another optional sound element: a passive radiator on the sealed cabinet of the second driver. It captures subtle yet viable sound waves, just as an acoustic guitar sound board/top does. Now, a total four distinct, correctly processed sound sources are in the mix, numerous harmonic frequencies, and the deep, full-chamber sound from this speaker cabinet. The structural elements and their functional combination provides a speaker cabinet that effectively amplifies the full and natural sound of an acoustic guitar, or any stringed instrument. The are many benefits. Musicians are more aware of their own sound, can be more creative, and can match the volume of other musician's instruments in a live performance without sounding harsh. The sound engineer easily dials in the amplified sound to match the natural acoustic guitar sound, and has fewer problems doing so.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein:

FIG. 1 is an isometric view of the invention.

FIG. 2 is a front view of the invention.

FIG. 3 is a right side view of the invention.

FIG. 4 is another front view of the invention with a section line AA down the center.

FIG. 5 is section A-A from FIG. 4, showing many components details as-well-as sound wave directions within and without the cabinet.

FIG. 6 is another right side view with hidden lines visible, and two section lines thru it.

FIG. 7 is section B-B which is through the front panel of the cabinet, showing relative placement of holes and a speaker drivers.

FIG. 8 is section C-C which is through the body of the cabinet, showing the tube and tube mounts.

FIG. 9 is an isometric view of the invention.

FIG. 10 is a front view of the invention.

FIG. 11 is a right side view of the invention.

FIG. 12 is a front view of the cabinet invention with section line A-A down the center.

FIG. 13 is section D-D from FIG. 12, showing many components as-well-as sound wave directions within and without the cabinet of this further development/embodiment, which has many optional, yet preferable sound enhancements.

FIG. 14 is another right side view with hidden lines visible, and section lines thru it.

FIG. 15 is section E-E which is through the front panel of the cabinet, showing relative placement of holes and a speaker drivers.

FIG. 16 is section F-F which is through the body of the cabinet, showing the tube and tube mounts, guitar shape, and deflectors

DETAILED DESCRIPTION OF THE INVENTION

FIGS. 1 thru 8 show a basic embodiment of this speaker cabinet 10. Speaker Cabinet 20, as shown in FIG. 9 thru 16 is a further development/embodiment.

Figure 1:
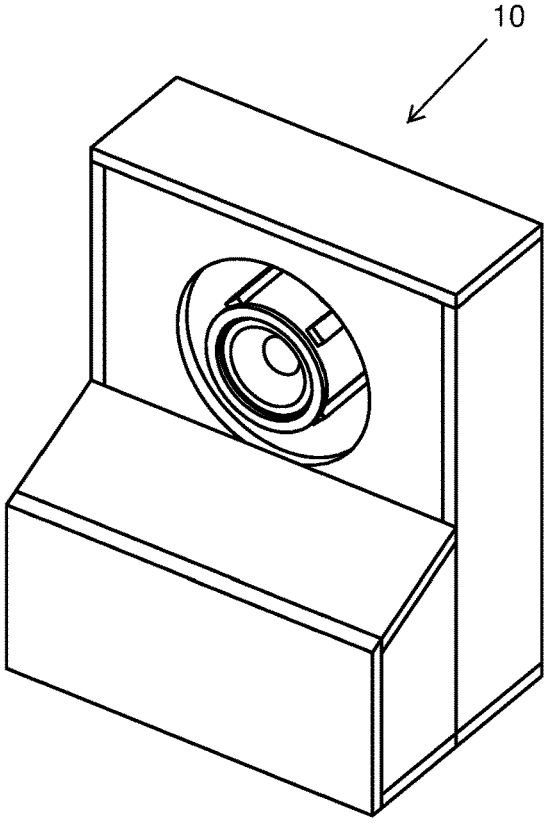
FIGS. 1 thru 8 shows the Speaker Cabinet in a basic embodiment form, i.e., with a minimum amount of features, yet capturing the essence of the invention.
Figure 2:
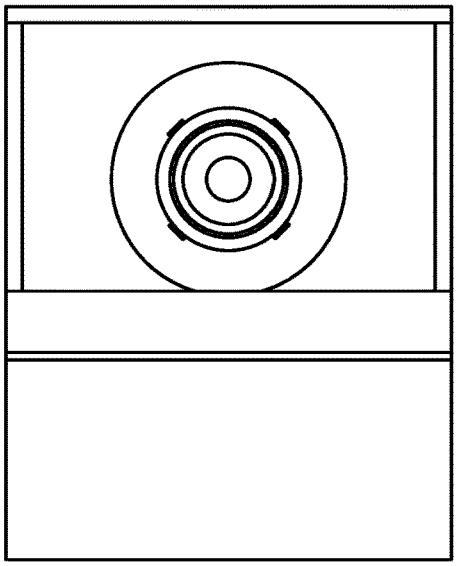
Figure 3:
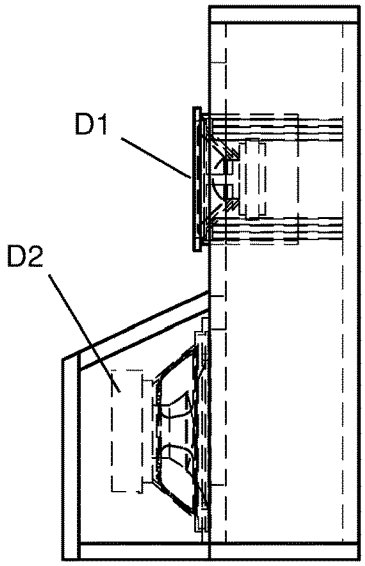
Figure 4:
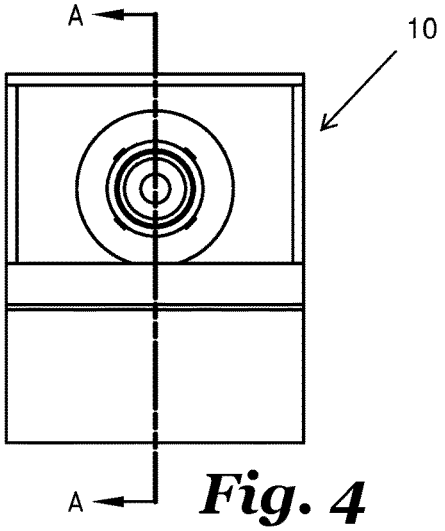
Figure 5:
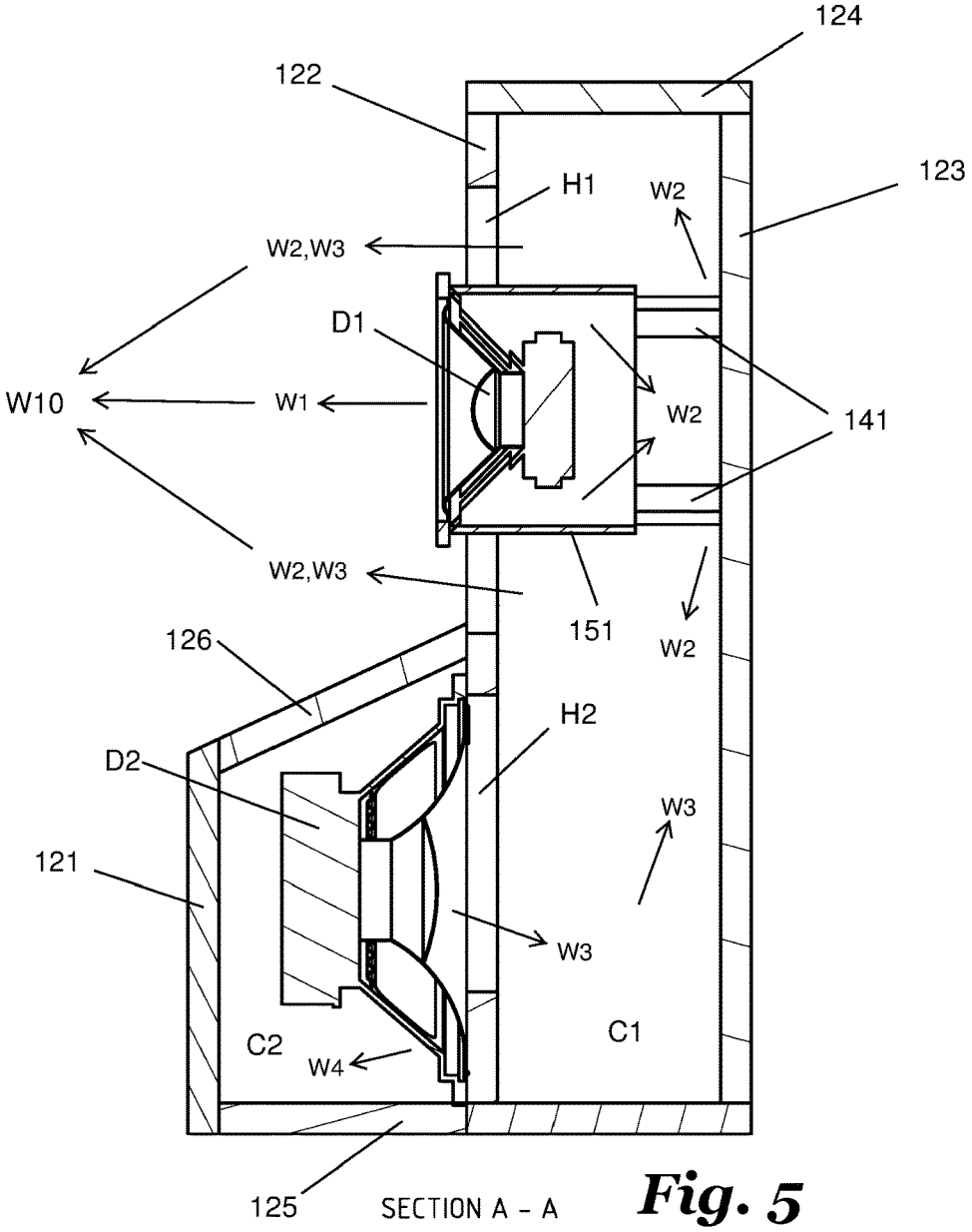
Figure 6:
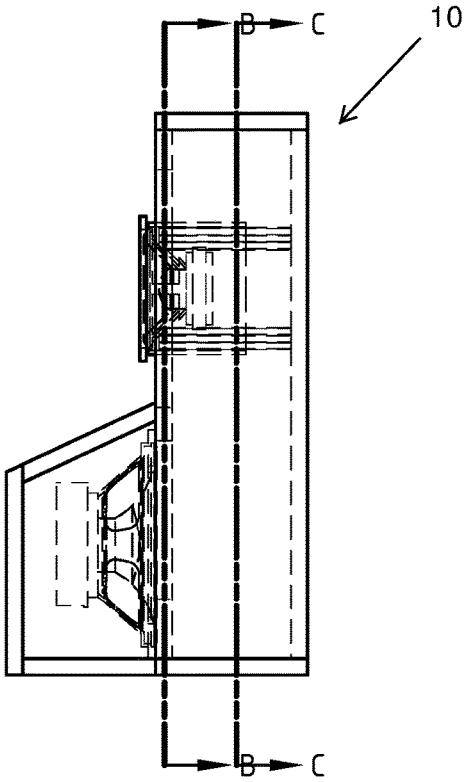

OVERVIEW OF COMPONENTS, BASIC EMBODIMENT CABINET 10, FIG. 5. The fundamental components of speaker cabinet 10 are: two speaker drivers D1 & D2, two chambers C1 & C2, a sound hole H1, and a tube 151. D1 is inside sound hole H1 of chamber C1 and is radiating outwards as well inwards, insides chamber C1. Driver D2 is inside chamber C2, facing the opposite as D1 (as shown in drawings), and radiating into chamber C1 thru H2. Chambers C1 & C2 are comprised of various panels. Drivers D1 & D2 have different functions from each other; D1 emphasizes mids, highs, and direct sound, and D2 emphasizes mids, lows, and indirect/reflected sound. Components C1, C2, D1, D2, H1, H2, & 151 are all working as a system to bring the mix of sound waves W1, W2, & W3 in front of the cabinet, producing the final mix of sound, W10.

Figure 8:
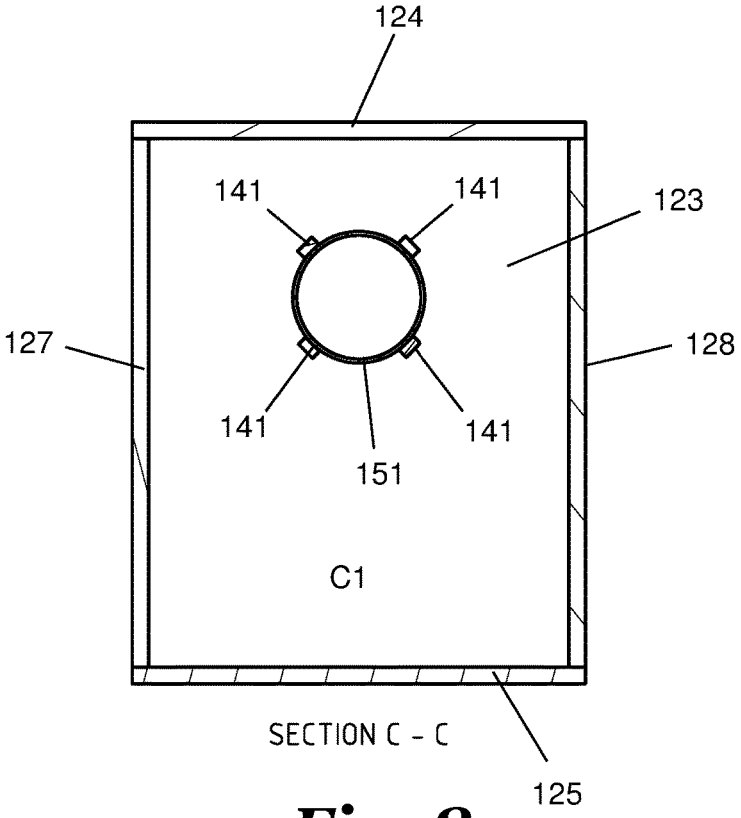
Figure 9:
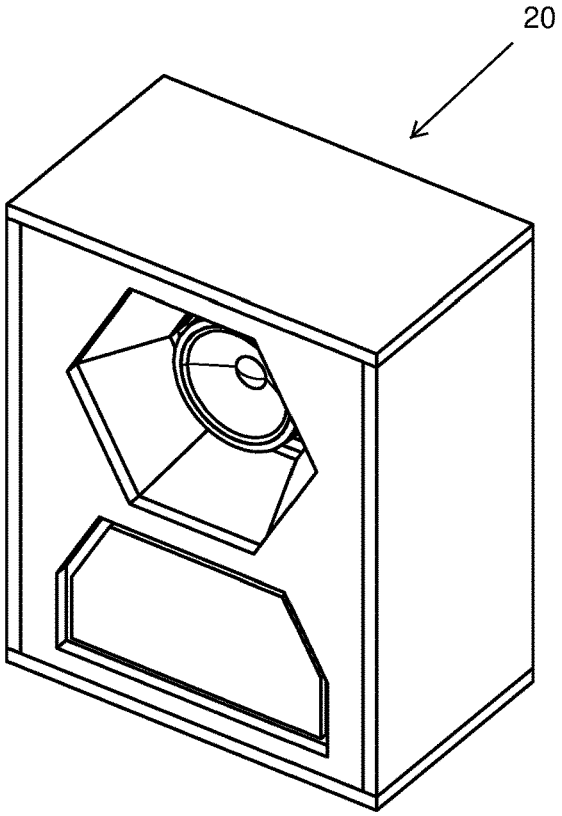
FIGS. 9 thru 16. Shows the cabinet in a further development/embodiment form, i.e., with optional, and many times preferred features to enhance sound quality of the invention.
Figure 10:
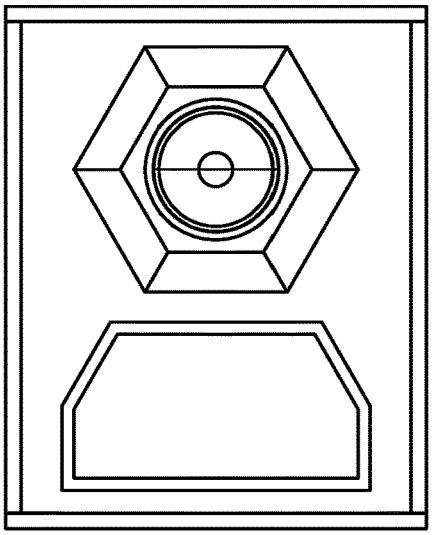
Figure 11:
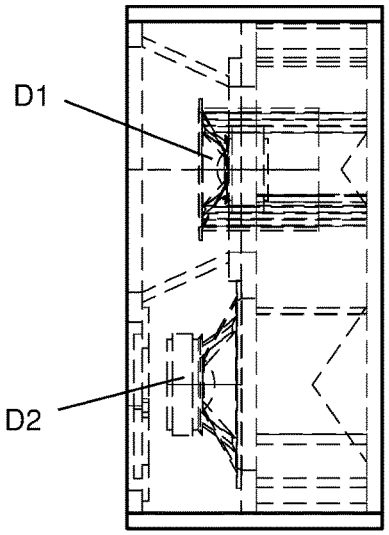

CABINET PANELS, FIGS. 5 & 8. The speaker chambers C1 & C2 are made from panels. In embodiment 10, they consist of front panel 121, mid panel 122, & rear panel 123. As typical in speaker enclosures, there is a top panel and bottom panel, 124 & 125, and side panels 127 & 128 (not shown in FIG. 5). It is preferable to construct these panels from plywood with qualities and thickness associated with normal speaker construction, but other raw materials such as press wood, solid wood, composites, and even metals can be used as well depending upon the design intent. FIG. 8. The top, bottom, and side panels, 124, 125, 127, & 128 respectively, along with back panel 123 are shown as a rectangle box shape, the common speaker cabinet shape. However, it can be square, circular, polygon or any natural shape because the components and features are present in basic embodiment cabinet 10. Therefore the number of panels may increase or decrease depending on which shape is used.

Panels 121, 122, & 123 are preferably as shown parallel (for manufacturing) with each other, as are sides 127 & 128, or top 124 & bottom 125.). Then can also be angled to each other to help eliminate standing waves. Also, the drivers themselves, D1 & D2 can be mounted at an angle with an adapter so that the panels can remain parallel, and still achieve the desired sound result to reduce standing waves.

SPEAKER DRIVERS, FIG. 5. The preferable driver type is a full-range, flat-response (FRFR) driver. The possible frequency range of these types of speaker drivers can be 20 Hz to 20 kHz (the range of human hearing). A typical range of 50 Hz to 15 kHz will capture the full spectrum of sound from a stringed instrument. (Typical electric guitar speaker drivers are not preferred because of their limited range and characteristics built into them to achieve sound coloration.) In both cabinets 10 & 20, D1 is preferred smaller than D2, where D1 is a 3 to 7" driver, and D2 is a 6 to 12" driver. The drivers can each be smaller or larger than just stated, depending on various embodiments of the design. They can also be the same size as one another, or D1 larger than D2, all depending upon the design intent of the embodiment. It is preferable to power each of the drivers with its own source, as in the case of a bi-amp or stereo amplifier: Channel A driving D1, channel B driving D2 or vice-versa. This configuration allows more control to each driver, e.g., for balancing the volumes or effects, as-well-as enabling the option for dual inputs from the guitar, and is a common feature on higher model acoustic amplifiers today. Alternatively, a single source of power can be used to drive both speakers, allowing ease of operation, but with less control. In either case, matching the amplifier power output and ohms rating to the speaker driver is essential.

REVIEW OF FLOW OF SOUND, FIG. 5. The instrument electrical signal reaches both drivers D1 & D2 at the same time. However, each driver has a unique purpose. Speaker driver D1 instantly radiates sound wave W1 forward from the speaker enclosure to the listener's ear, and wave W2 (discussed shortly) rearward, into the C1. Sound wave W3 from speaker driver D2 is also processed through chamber C1, then through sound hole H1. So then, W3 sound wave mixes with sound wave W1. The time delay between the two drivers, and the processed sound in C1 is subtle yet distinctly noticeable. Therefore, an amp setting involving reverb to achieve the processed sound of C1 (like the body of an acoustic) is unnecessary. This is just one desirable quality a musician listens for in an amplifier. The same sound wave W3 has other qualities besides delay: it has depth. The lows from D2 are able to expand and build in chamber C1 from cabinet panels 121-127. When C1 is full with sound, it passes through sound hole H1. Since lows (bass notes) reproduce so well in this sound chamber, no adjustment of EQ knobs are necessary to match the acoustic guitar's bass qualities, so they are best kept 'flat'. Still more dynamics are taking place. Speaker driver D1 has rearward sound wave W2 going through tube 151 inside the body of a guitar and into chamber C1 of the speaker cabinet. The wave W2 is now also in the mix of C1 with sound wave W3 from D2. These waves are adding, multiplying, subtracting, and harmonizing with each other. Effects such as chorus or presence are unnecessary to match the tone quality of the instrument. These processed sound waves W2 & W3 proceed through H1, also mixing with W1 to form the whole mix of W10. It is clean, full, and natural sounding, and now with added value—it can be turned up without sacrificing sound quality.

SMALL CHAMBER SIZE & LOCATION, FIG. 5. The enclosure C2, made of the panels, is small, similar in size to a horn-loaded speaker enclosure because it is driving sound into a certain volume, chamber C1. This keeps the front and backwards excursions of speaker driver D2 relatively equal. Insulation of almost any type is preferably used, such as fiberglass, cloth, foam, and other types specifically made for that. Driver D2 is mounted on mid-panel 122 but can be mounted on top panel 124 or bottom panel 125, the rear panel 123 or side panels 127 or 128. The rear sound wave W4 from the cone of D2 are enclosed by panels 121, 125, 126 and side panels. These keep the rear waves from over-powering the front sound wave of W1. The enclosure C2 with the panels can itself be located inside C1 and doesn't change the function at all. This would enable the possibility of mounting it on 1 of 6 panels. For example, it could mount on inside top of panel 124, allowing it to radiate sound downwards. It can be mounted to the back, side, or bottom panels as well.

Figure 7:
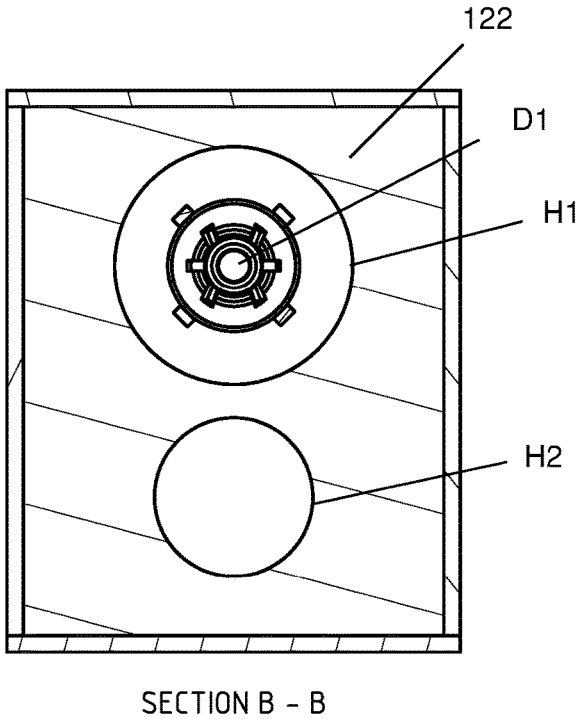

DRIVER MOUNTED ON TUBE, FIG. 5. D1 is mounted on and in tube 151, which in turn is mounted on mounts 141. The assembly is mounted inside a hole H1. The tube 151 can be cylindrical, as shown, but preferably it should be a non-constant volume shape, such as a parabola or cone, and as such will not be predisposed to any special frequencies. The material of tube 151 can be made of PVC plastic or similar hard, strong material. Securing mounts 141 to tube 151 can be accomplished using glue, screws, or similar commonly used mounting methods. They can be secured to back panel 123 in a similar way and with small feet. Quantity and spacing of 141 mounting shall be suitable for strength to hold tube 151 and driver D1 assembly, keeping in mind the rugged movement of amplifiers during travel. The quantity of four equally spaced mounts 141 are shown in FIGS. 7 & 8. Mounting tube 151 is mounted with a space of a suitable distance away from back panel 123 for the area of the rearward wave W2 of D1 to exit into chamber C1. A space of approximately 1 to 2" for 5" speaker driver D1 is sufficient. At the same, tube length of 151 should be long enough to block rear wave W2 from canceling out front wave W1. The front face of D1 can therefore protrude out past mid-panel 122 as shown.

DRIVER/TUBE ASSEMBLY INSIDE SOUND HOLE, FIG. 5. Tube 151 is inside and preferably axially centered to hole H1, as shown in FIG. 7. The hole shown is circular, but may be a hexagon, octagon or other shape. The area of the H1 is preferably not greater that the combined area of speaker cones D1 & D2, or preferably not less than D1 itself, i.e., that there is sufficient volume, yet have enough back pressure for sound waves W2 & W3 to exit the chamber C1. In FIG. 7, it is shown that drivers D1 & D2 are mounted on the center-line of mid-panel 122 which is preferable because it is similar to an acoustic guitar. The drivers can also be mounted towards a corner, in the middle, next to each other, any configuration within the plane of panel 122 and which can be constructed. The hole H1 can also have multiple holes that either surround D1, are next to D1, or some other distance away from D1.

MOUNTING METHODS OF TUBE, FIG. 8. One method to mount tube 151 with driver D1 is shown using mounts 141. They are fastened to side of tube 151 with glue, screws, or any similar method considering the raw materials and suitable to withstand the vibrations of driver D1 and D2, as-well-as possibility of cabinet dropping. The uprights 141 shall also be fastened to the inside back of panel 123 with same methods described above. Alternatively, tube 151 can be attached to panel 122 with suitable side mounting brackets to hold it centrally located within hole H1 (as previously stated). Mounts 141 are not needed to attach to tube 151 or to bottom panel 123 in the mounting method. Another alternative mounting method of tube 151 and mounts 141 is to make them both into one (1) part. This is very feasible with the advent of 3D printing. Another alternative mounting style (compared to it being fixed in some way) is to use an angular adjustable positioning mount. This would allow the D1/151 assembly to be pivot within hole H1 for best suitable angle to a musician's taste, e.g. pointing upwards not just straight out. This is akin to tilting the cabinet back as done by many musicians. It can be accomplished by a horizontal axle rod, centered on D1, and mounted on mid panel 122.

SMALLEST POSSIBLE EMBODIMENT, FIG. 5. It would be advantages in certain venues of sound stages, auditoriums, traveling considerations, and other scenarios to have and embodiment with the smallest possible speaker cabinet, yet retain the qualities of sound as described in 'THE FLOW OF SOUND'. The cabinet dimensions therefore, need to consider largest driver D2 and its chamber C2. As stated earlier in 'SMALL CHAMBER SIZE AND LOCATION', C2 can be mounted virtually anywhere on or in chamber C1. When it is located directly behind D1 on the back panel 123 so that the axes are in line with one another, this cabinet is an example of the smallest configuration. However, in this configuration, sound wave D2 would be directly radiated into wave W2 from D1 and so in light of this consideration, it will be necessary to use an alternative design of tube 151, rather than just straight down. The tube can be bent at an angle like an elbow fitting so that the negative effects of D2 are limited.

FIGS. 9 thru 16 show another embodiment of the inventive speaker cabinet. Refer next ADDED COMPONENTS OF FURTHER EMBODIMENT CABINET 20, FIGS. 13, 15, & 16. RESONATING CHAMBER C3, FIG. 16. Panels 224, 225, 227, & 228 are much the same as in cabinet 10; however, inside the cabinet are shape walls 262*a, b, c*, & d, and ends 261. These make the familiar shape of an acoustic guitar body, as do ends 261, and is a preferred shape of resonating chamber C3. The walls and ends use that shape to deflect the sound waves W2 & W3 in a similar way as an acoustic guitar body. Although the complex nature of these vibrations, deflections, and resonances produce by such a chamber are hard to document in the scientific/technological world of sound—suffice-it-to-say—we like the sound it produces. These walls a preferably made from a wood source such as plywood, solid wood and wood composites. Other materials such as polymers and other rigid materials may also be used, depending upon the design intent. The shape is made with straight pieces that are the same height as inside the C3, from mid panel 222 to back panel 223. This acoustic guitar body shape can also be made with curved, bent, or otherwise formed pieces of wood or material to resemble the shape of the body. The whole group of pieces 261 and 262*a* thru 262*d* can also be made of one (1) single piece. With 3D printing this is a viable option which may be preferable depending upon design intent. Also present in chamber C3 are deflector peaks 271 & 272. Although similar in shape to the guitar body, cabinet 10 & 20 have the difference of powered sound from drivers D1 & D2, as such, add sound challenges, e.g. standing waves. Since there is a minimum or no sound insulation in chamber C3, it is preferable to allow the sound waves W2 & W3 to deflect sideways as opposed to deflect straight back (because of parallel panels 222 & 223), from the back panel 223 and back into drivers D1 & D2. They can be made of wood or with the materials used for walls 262 and ends 261. The shapes can be pyramidal in shape, conical, semi-spherical, or almost any organic shape. They should have approximately the same area as it's respective driver cone D1 or D2, and are preferably mounted directly under each driver D1 & D2 for best deflection performance. The shapes can be fastened with glue, screws, nails, or similar methods common in manufacturing of cabinets.

Figure 12:
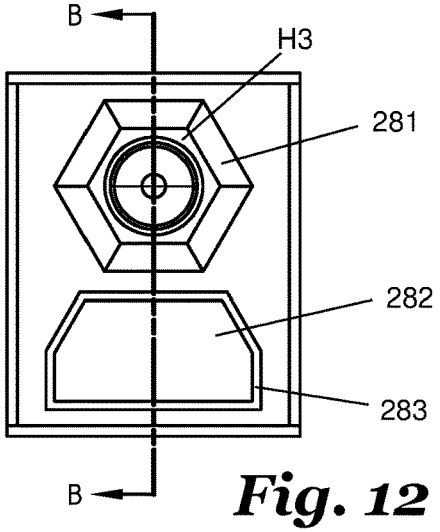
Figure 13:
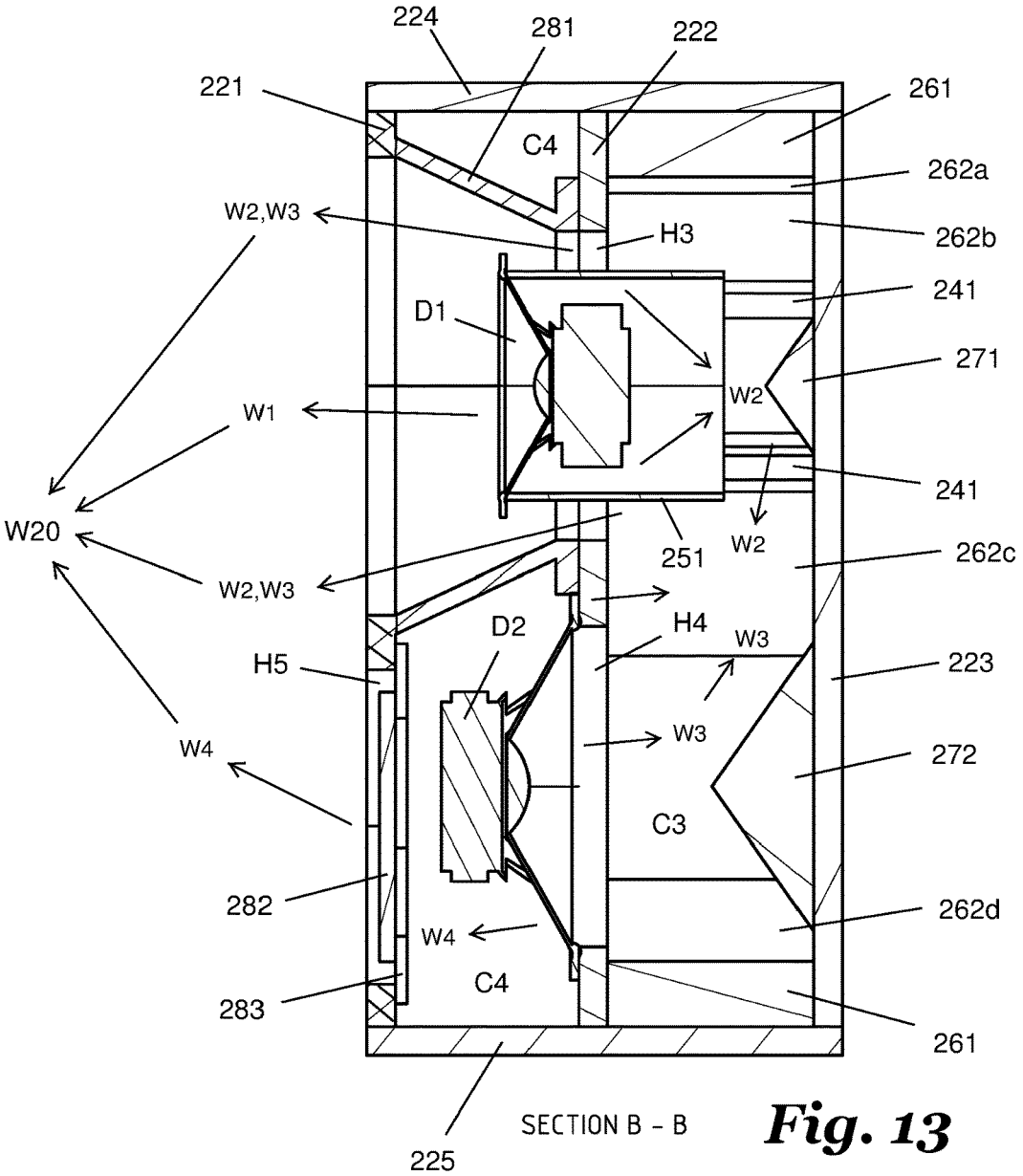
Figure 14:
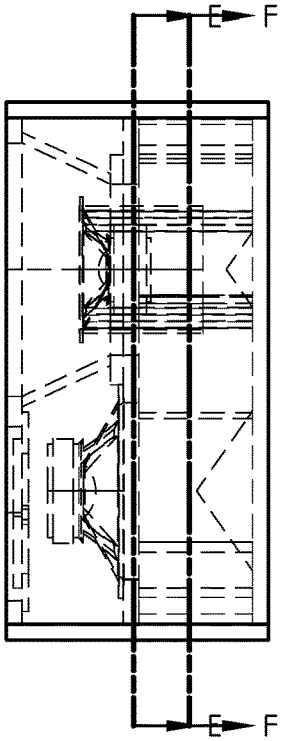

HORN-LOADED SOUND HOLE (HLSH), FIG. 13. Component 281 is configured to provide an extension of sound hole H3 and aids in the controlled expansion of sounds waves W2 & W3 as they radiate out from C3. Cross-section view, FIG. 13, shows the shape as having a constant expansion rate. It can be parabolic, hyperbolic, other type of expansion and even no expansion at all, depending upon the design intent. FIG. 12 shows the front profile view of HLSH 281 in cabinet 20 with a hexagon shape. This shape can be circular, square, rectangular, other polygon shape, triangle, or uneven and natural shapes depending upon the design intent. HLSH 281 can be made from similar materials as stated for wall shapes 262 and peak deflectors 271 & 272. The attachment method is also similar to 262, 271, & 272 as well. HLSH 281 is located between panels 221, front, and back panel 222. It can be part of panel 221 or part of 222, or both so that panels 221, 222, and HLSH 281 become one part. Another variation is to also combine tube 251. Using 3D printing methods with the many choices of resins, the components tube 251, HLSH 281, and mounts 241 can all become one part. This concept can go further by adding in either the front or mid panels, 221 or 222, or both. The variation of having D1 tilt with 251 should be kept in mind, allowing the possibility of making adjustable angle option as stated in cabinet 10.

PASSIVE RADIATOR & FLEXIBLE SURROUND, FIGS. 12 & 13. Passive radiator (PR) 282 is shown mounted inside hole H5. The hole shall be made in shape similar to PR 282 with sufficient space to allow vibration of H5 without contacting front panel 221 having a space of approximately ½" all around. It is preferable to use a rubber, flexible surround (FS) for 283, as this aids in the vibration of PR 282. The surround is preferably hollow so that approximately ¾" is overlapping into front panel 221, and ¾" overlapping into PR 282, for a total width of approximately 2". The surround can also be made of strips of rubber, depending upon the design intent. The surround can be made from rubber, silicon, heavy cloth, or similar flexible, non-porous material. The shape of 282 & 283 are preferably similar to each other for purposes of mounting to panels and operation. PR 282 is preferably made from a piece of thin, light wood to aid in its vibrations of itself and with the surround. Veneer plywood, solid wood, plastics, and even metal can be used depending upon the design intent. It is preferable to use solid Sitka Spruce wood as a material as it has very good vibration qualities as proven in many stringed instruments today, and this feature has the same purpose the top/soundboard of an acoustic guitar. A difference is that there is no x-bracing required on 282 because there is no bridge, saddle, or strings like a guitar, which requires a rigid mounting system. It is shown as rectangular in shape with chamfered corners, but can be almost any shape that fits into area below HLSH 281. It can be smaller than what is shown as well, or have multiple smaller copies with varying shapes and sizes. It can also be made to be interchangeable with itself so that other types of wood can be chosen and traded with minimum effort, given various wooden sound effects. The fastening methods of PR 282, FS 283 and front panel 221 are similar to other parts of cabinet 10 & 20. An additional consideration should be made in the bonding of dissimilar materials together. A 2-part adhesive, specifically for the bonding of rubber to other materials can be used, such as for weather stripping of doors and windows of cars.

Figure 15:
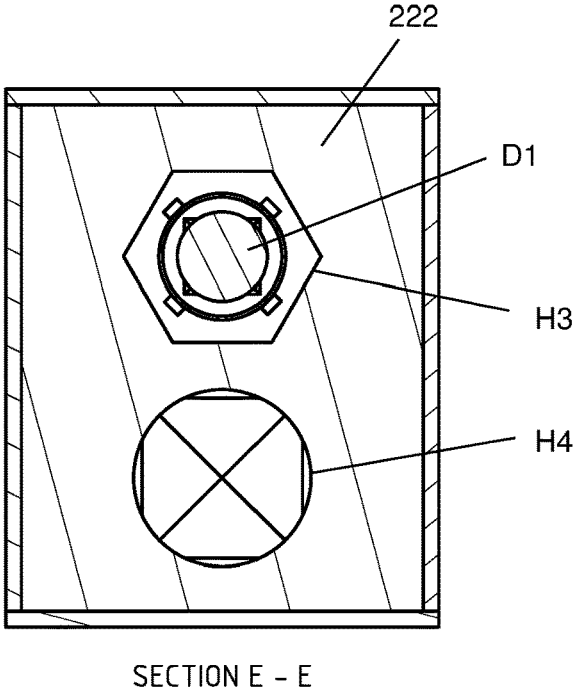
Figure 16:
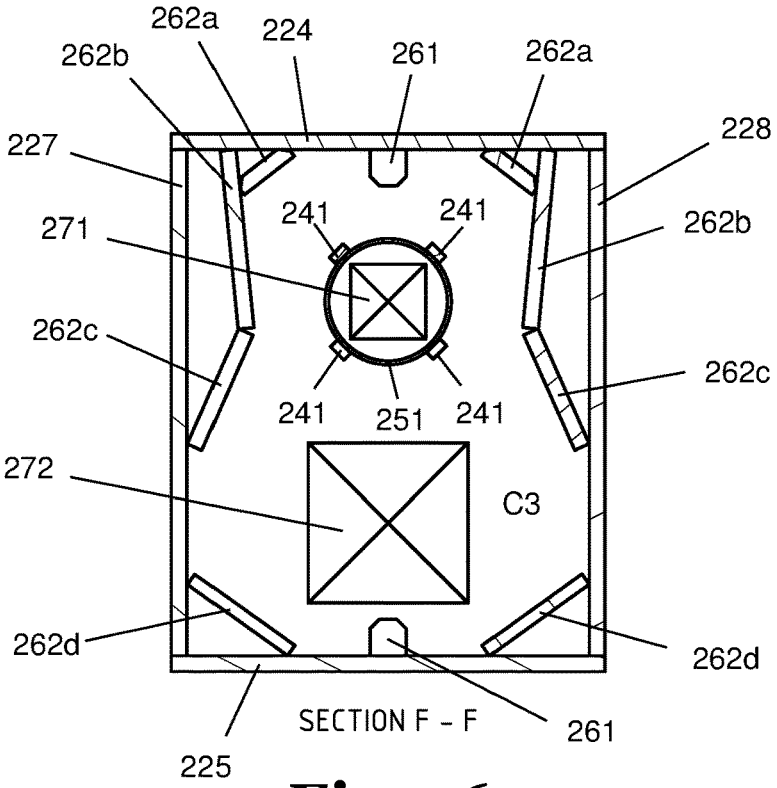

CHAMBER C4 OF CABINET 20, FIGS. 13 & 15. With the preferable addition of HLSH 281, the front panel 221 is larger than panel 121 of cabinet 10. There is now more volume in C4 and depending on the size & resonant frequency of driver D2, which could benefit the sound wave W4. If it does not or does not make a difference, chamber C4 can be made smaller, as in cabinet 10. It can be accomplished with a barrier of sound in C4 to divide the chamber into 2, or another method, such as changing the shape of HLSH 281 to extend across the face of panel 221. In that case, the current top part of C4 no longer a chamber, and that space can then be used for other items such as cables, mixers and amplifiers.

FLOW OF SOUND IN CABINET 20, FIG. 13. With the above 4 mentioned preferable additions, which are dependent on the features of basic embodiment speaker cabinet 10. Note the basic components of sound that are essentially the same. The component call-outs C1, C2, D1, D2, H1, H2, & 151 from cabinet 10 now use call-outs these: C3, C4, D1, D2, H3, H4, & 251. Drivers D1 & D2 are the same as there is no reason to change the drivers in these embodiments. It shall be shown that the sound quality will improve for a number of reasons, starting with sound waves W2 & W3 which flow from chamber C3 through sound hole H3. The waves are now coupled against sides of HLSH 281 to aid in the efficiency of these sound waves. This is confirmed in light of chamber C3 having a limited volume, which is the design intent of most horn-loaded cabinets to aid the forward excursions, so they are relatively equal to the rearward excursions. Also, sound wave W1 improves efficiency because of a 'virtual horn-loaded' wall. This is because waves W2 & W3 have actual mass which sound wave W1 can be coupled against, similar to W2 & W3 being coupled against the HLSH 281. Sound waves W2 & W3 inside the cabinet are also benefited from the additional walls 262 shaped like the body of a guitar, and deflector peaks 271 & 272. As a result, the quality of sound even more closely matches the sound quality of the original stringed instrument. Also, the volume into and from the cabinet can be turned up even further to effectively amplify the sound without compromising quality. One more area of added sound quality comes from sound wave W4. This is first processed in cavity C4 from the rear excursions of driver D2. In cabinet 10, these vibrations are absorbed in insulation which do aid in the forward excursions of D2. In this embodiment cabinet 20, the sound waves can act on passive radiator 282, just as in the top of an acoustic guitar. Because there is no X-bracing (as in an acoustic guitar) the efficiency of its sound production is very good. With the quality of waves W1, W2, & W3 enhanced, along with addition of sound wave W4, the final mix of sound wave W20 approaches the same sound quality of original source. With the more efficient use of sound from these added features, this is truly an innovative speaker cabinet that effectively amplifies the full and natural sound from an acoustic guitar.

From the foregoing, it will be appreciated that in its most essential aspect the inventive speaker cabinet includes a top panel, a bottom panel, right and left side panels, a front panel, a back panel, and a mid-panel, the panels configured to define a resonant chamber and a second chamber, wherein the mid-panel has a first sound hole, and one of the top, bottom, side, back, or mid-panels has a second sound hole; a mounting tube mounted on tube mounts in the first sound hole and extending from the front panel a portion of the distance to the back panel, the mounting tube having an open rear end; a forward-directed first speaker driver mounted in the mounting tube for projecting sound waves directly outward from the mid-panel panel as well as rearward through the open rear end of the mounting tube; and a rearward-directed second speaker driver enclosed in the second chamber and mounted in front of the second sound hole for projecting sound waves into the resonant chamber; wherein the first sound hole is dimensioned with a perimeter edge spaced apart from the mounting tube such that the mounting tube is surrounded by a sound port, and wherein the direct and reflected sound wave from the second speaker driver and the direct and reflected rearward directed sound wave from the first speaker driver projected through the open rear end of the mounting tube combine in the resonant chamber and then pass outward from the resonant chamber through the sound port following in time the sound waves projected directly outward from the first speaker driver.

SEQUENCE LISTING

Not applicable.

What is claimed as invention is:

1. A ported speaker enclosure, comprising:

a top panel, a bottom panel, right and left side panels, a front panel, a back panel, and a mid-panel, said panels configured to define a resonant chamber and a second chamber, wherein said mid-panel has a first sound hole, and one of said top, bottom, side, back, or mid-panels has a second sound hole;

a mounting tube mounted on tube mounts in said first sound hole and extending from on or near said mid-panel a portion of the distance to said back panel, said mounting tube having an open rear end;

a forward-directed first speaker driver mounted in said mounting tube for projecting sound waves directly outward from said mid-panel panel as well as rearwardly through said open rear end of said mounting tube; and a rearward-directed second speaker driver enclosed in said second chamber and mounted in front of said second sound hole for projecting sound waves into said resonant chamber;

wherein said first sound hole is dimensioned with a perimeter edge spaced apart from said mounting tube such that said mounting tube is surrounded by a sound port, and wherein the direct and reflected sound waves from said rearward-directed second speaker driver and the direct and reflected rearwardly directed sound waves from said first speaker driver projected through said open rear end of said mounting tube combine in said resonant chamber and then pass outward from said resonant chamber through said sound port following in time the sound waves projected directly outward from said first speaker driver.

2. The ported speaker enclosure of claim 1, wherein said front panel, said mid-panel, and said back panel are generally planar and generally parallel to one another.

3. The ported speaker enclosure of claim 1, wherein said front panel, said mid-panel, and said back panel are generally planar but not parallel to one another so as to reduce standing waves.

4. The ported speaker enclosure of claim 1, wherein said forward-directed first speaker driver and directed second speaker driver are mounted with an axis of sound dispersion generally parallel with one another.

5. The ported speaker enclosure of claim 1, wherein said forward-directed first speaker driver and said directed second speaker driver are mounted with an axis of sound dispersion not parallel with one another so as to reduce standing waves.

6. The ported speaker enclosure of claim 1, wherein said rearward-directed second speaker driver is mounted on any one of said mid-panel, said top panel, said bottom panel, said rear panel, or one of said side panels.

7. The ported speaker enclosure of claim 1, wherein said rear open end is spaced apart from said back panel to provide a volume into which said rearwardly directed sound waves from said forward-directed first speaker driver may exit into said resonant chamber.

8. The ported speaker enclosure of claim 1, wherein said forward-directed first speaker driver includes a face that extends either outwardly, or inwardly from said mid-panel.

9. The ported speaker enclosure of claim 1, wherein said forward-directed first speaker driver is positioned axially within said first sound hole.

10. The ported speaker enclosure of claim 1, wherein said first sound hole defines an area not less than the area of a speaker cone of said first speaker driver and not greater than the combined area of the speaker cones of said forward-directed first speaker driver and said rearward-directed second speaker driver, so as to ensure that there is both sufficient volume and sufficient back pressure for mixed sound waves to exit said sound port.

11. The ported speaker enclosure of claim 1, wherein said forward-directed first speaker driver and said rearward-directed second speaker driver are mounted either on the midline of said mid-panel, off center of said mid-panel, or in corners of said mid-panel.

12. The ported speaker enclosure of claim 1, further including shape walls disposed in said resonant chamber to form the interior shape, as formed by the side walls of an acoustic guitar body, referred to as the treble, waist, and bass parts of an acoustic guitar.

13. The ported speaker enclosure of claim 1, further including sound deflectors in said resonant chamber.

14. The ported speaker enclosure of claim 1, further including a horn-loaded sound hole coupled to said first sound hole and configured as an extension of said first sound hole to control the expansion of sound waves radiating from said resonant chamber.

15. The ported speaker enclosure of claim 14, wherein said horn-loaded sound hole is located between said front panel and said back panel.

16. The ported speaker enclosure of claim 1, wherein said second chamber includes a shaped sound hole, a rubber surround affixed to the opening of said shaped sound hole, and a passive radiator mounted on said rubber surround behind said rearward-directed second speaker driver so as to produce sound waves projected rearwardly from said rearward-directed second speaker driver.

17. A ported speaker enclosure comprising: only one speaker driver; a mounting tube mounted on tube mounts in a sound hole and extending from on or near a mid-panel, a portion of the distance to a back panel, said mounting tube having an open rear end; the first sound hole dimensioned with a perimeter edge spaced apart from the mounting and the mounting tube surrounded by a sound port and a forward-directed speaker driver mounted in said mounting tube for projecting forward-directed sound waves directly outward as well as rearwardly directed sound waves through said open rear end of said mounting tube, then back out so that the rearward-directed waves mix with the front-directed sound waves.

18. A ported speaker enclosure comprising: a front panel, a back panel, and a mid-panel, said panels configured to define a resonant chamber and a second chamber; a mounting tube mounted on tube mounts in a first sound hole and extending from on or near said mid-panel, a portion of the distance to a back panel, said mounting tube having an open rear end; a forward-directed speaker driver mounted in said mounting tube for projecting front-directed waves directly outward and for projecting rearward-directed sound waves through said open rear end of said mounting tube, then back out through said first sound hole for said rearward-directed sound waves to mix with said front-directed waves; a second chamber that includes a shaped sound hole, a rubber surround affixed to the opening of said shaped sound hole, and a passive radiator mounted on said rubber surround behind a rearward-directed speaker driver, said rearward-directed speaker driver to produce first sound waves projected toward said passive radiator and project second sound waves into said resonant chamber to mix with said rear-directed sound waves of said forward-directed speaker driver said second speaker driver so as to produce sound waves projected rearwardly from said second speaker driver; the front-directed waves of said speaker radiate into a resonating body, then out into the air.

19. The ported speaker enclosure of claim 1, wherein said lower driver is mounted on any one of said mid-panel, said top panel, said bottom panel, said rear panel, or one of said side panels.

20. The ported speaker enclosure of claim 1, wherein said second chamber is positioned inside said resonant chamber.

* * * * *